US010774616B2

(12) United States Patent
Al-Badran

(10) Patent No.: US 10,774,616 B2
(45) Date of Patent: Sep. 15, 2020

(54) SYSTEMS AND METHODS FOR EXTINGUISHING OIL AND GAS WELLS

(71) Applicant: Saudi Arabian Oil Company, Dhahran (SA)

(72) Inventor: Mohammad Saud Al-Badran, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/046,230

(22) Filed: Jul. 26, 2018

(65) Prior Publication Data

US 2020/0032618 A1 Jan. 30, 2020

(51) Int. Cl.
*E21B 35/00* (2006.01)

(52) U.S. Cl.
CPC ..... *E21B 35/00* (2013.01)

(58) Field of Classification Search
CPC ..... E21B 35/00
See application file for complete search history.

(56) References Cited

U.S. PATENT DOCUMENTS

| | | | | |
|---|---|---|---|---|
| 1,679,243 A | | 7/1928 | Fasul | |
| 4,323,118 A | | 4/1982 | Bergmann | |
| 5,119,887 A | | 6/1992 | Rosa | |
| 5,154,234 A | | 10/1992 | Carrico | |
| 5,170,846 A | * | 12/1992 | Hope | E21B 33/02 166/379 |
| 5,180,018 A | * | 1/1993 | Taylor | A62C 3/02 169/47 |
| 5,247,999 A | | 9/1993 | Fowler | |
| 5,309,989 A | | 5/1994 | Grimsley | |
| 6,666,278 B2 | | 12/2003 | Cicanese | |
| 9,540,907 B1 | | 1/2017 | Plessis et al. | |
| 9,650,874 B2 | | 5/2017 | Caldwell et al. | |
| 9,869,149 B2 | | 1/2018 | Al-Badran | |
| 2018/0094500 A1 | | 4/2018 | Al-Badran | |

FOREIGN PATENT DOCUMENTS

| | | |
|---|---|---|
| DE | 4107492 A1 | 9/1992 |
| GB | 2055414 A | 3/1981 |
| GB | 2254553 A | 10/1992 |
| WO | 9219323 A1 | 11/1992 |
| WO | 2013034046 A1 | 3/2013 |

OTHER PUBLICATIONS

International Search Report and Written Opinion for related PCT application PCT/US2019/043646 dated Dec. 13 2019.

* cited by examiner

*Primary Examiner* — Brad Harcourt
(74) *Attorney, Agent, or Firm* — Bracewell LLP; Constance G. Rhebergen; Linda L. Morgan

(57) ABSTRACT

Systems and methods for extinguishing a hydrocarbon well include a housing with an inner chamber sized for placement over a wellhead member. The inner chamber extends from a base of the housing to a roof of the housing. An extinguishing materials injection system is operable to deliver extinguishing materials to the inner chamber of the housing. A valve is located at the roof of the housing. A ram sealing system is located at the base of the housing. The ram sealing system has a pair of rams, each ram having an engaging surface. The engaging surface is sized and shaped to seal around the wellhead member when the ram sealing system is in a closed position. The pair of rams are rotationally attached to a ram body. An arm link rotationally links each ram to the ram body.

16 Claims, 3 Drawing Sheets

SYSTEMS AND METHODS FOR EXTINGUISHING OIL AND GAS WELLS

BACKGROUND OF THE DISCLOSURE

1. Field of the Disclosure

The present invention relates generally to an extinguishing system for oil and gas wells, and more particularly to a portable room with an extinguishing system.

2. Description of the Related Art

There are times when hydrocarbon development wells may catch on fire, such as by way of human accident or natural event. As an example, an uncontrolled release of hydrocarbons, known as a blowout, during drilling operations can lead to a fire at the wellhead. Some current methods of extinguishing a fire at the wellhead can include using explosives to deprive the fire of oxygen, ejecting extinguishing materials on the wellhead, or adding casing to the wellhead member to raise the height of the flame above the ground.

During a fire at the wellhead quantities of hydrocarbons can be wasted and can pollute the environment. In addition, the process of extinguishing the fire can damage the hydrocarbon development and cause further environmental pollution.

SUMMARY OF THE DISCLOSURE

Embodiments of the present disclosure provide systems and methods for extinguishing oil and gas wells in a reduced amount of time while containing the hydrocarbons and extinguishing materials so that such hydrocarbons and extinguishing materials have a decreased impact on the environment compared to some currently available extinguishing systems. Systems and methods of this disclosure provide a housing for extinguishing a hydrocarbon well that includes a ram sealing system that can seal around the wellhead member and secure the housing to the wellhead member. The ram sealing system can seal against the pressure of the escaping hydrocarbons and the injected extinguishing materials.

In an embodiment of this disclosure, a system for extinguishing a hydrocarbon well includes a housing with an inner chamber sized for placement over a wellhead member. The inner chamber extends from a base of the housing to a roof of the housing. An extinguishing materials injection system is operable to deliver extinguishing materials to the inner chamber of the housing. A valve is located at the roof of the housing. A ram sealing system is located at the base of the housing. The ram sealing system has a pair of rams. Each ram has an engaging surface. The engaging surface is sized and shaped to seal around the wellhead member when the ram sealing system is in a closed position. The ram sealing system also includes a ram body. The pair of rams is rotationally attached to the ram body. An arm link rotationally links each ram to the ram body.

In alternate embodiments, each ram can include a base seal, the base seal forming a seal between such ram and the base of the housing. The engaging surface can be operable to anchor the ram sealing system to the wellhead member. Each ram can rotate around a pivot point and the pivot point can be static relative to the base of the housing. Alternately, the ram body can be secured to and static relative to the base of the housing.

In other alternate embodiments, the housing can include a sidewall that extends from the base to the roof. The base can include a base end surface extending across a base end defined by the sidewall. The base end surface can have a base opening sized to receive the wellhead member. When the ram sealing system is in the closed position, the ram sealing system can be operable to seal against a pressure of hydrocarbons and a pressure of injected extinguishing materials. The engaging surface can be an arc shaped seal and when the ram sealing system is in the closed position, the engaging surface can seal around an outer circumference of the wellhead member. The ram sealing system can further include an actuating member operable to move the ram sealing system between an open position and the closed position.

In an alternate embodiment of this disclosure, a method for extinguishing a hydrocarbon well includes placing a housing with an inner chamber over a wellhead member. The inner chamber extends from a base of the housing to a roof of the housing. A valve is provided at the roof of the housing. A ram sealing system is located at the base of the housing for sealing around the wellhead member. The ram sealing system has a pair of rams. Each ram has an engaging surface. The engaging surface is sized and shaped to seal around the wellhead member when the ram sealing system is in a closed position. The ram sealing system includes a ram body. The pair of rams is rotationally attached to the ram body. An arm link rotationally links each ram to the ram body. Extinguishing materials are delivered to the inner chamber with an extinguishing materials injection system.

In alternate embodiments, each ram can include a base seal and the base seal can form a seal between such ram and the base of the housing. The engaging surface can anchor the ram sealing system to the wellhead member. Each ram can rotate around a pivot point and the pivot point can be static relative to the base of the housing. Alternately, the ram body can be secured to and static relative to the base of the housing.

In other alternate embodiments, the housing can include a sidewall that extends from the base to the roof. The base can include a base end surface extending across a base end defined by the sidewall. The base end surface can have a base opening sized to receive the wellhead member. When the ram sealing system is in the closed position the ram sealing system can seal against a pressure of hydrocarbons and a pressure of injected extinguishing materials. The engaging surface can be an arc shaped seal. When the ram sealing system is in the closed position, the engaging surface can seal around an outer circumference of the wellhead member. The ram sealing system can be moved between an open position and the closed position with an actuating member.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

Embodiments of the present disclosure will now be described more fully hereinafter with reference to the accompanying drawings which illustrate embodiments of the disclosure. This disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
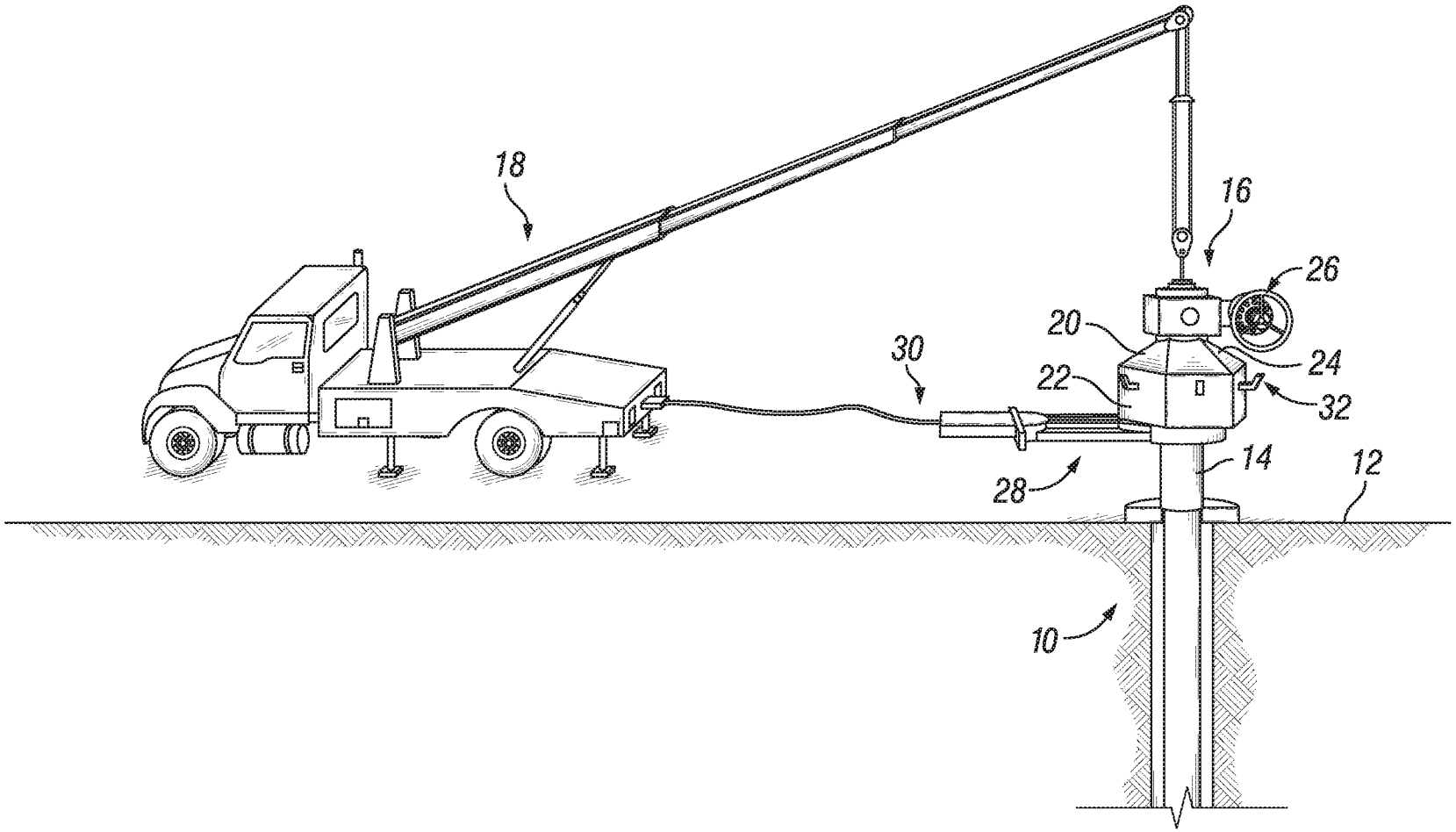
FIG. 1 is a perspective view of a system for extinguishing a hydrocarbon well, in accordance with an embodiment of this disclosure, shown being lowered onto a wellhead member.

Looking at FIG. 1, a hydrocarbon development operation can include subterranean well 10 that extends from earth's surface 12 towards a hydrocarbon reservoir. Wellhead member 14 can be positioned at earth's surface 12 downstream from subterranean well 10. During hydrocarbon development operations, such as during drilling, production, or shutting in of subterranean well 10, hydrocarbons may travel from subterranean well 10 and into wellhead member 14. There is a risk that such hydrocarbons could catch on fire.

Extinguishing assembly 16 can be used to extinguish a fire at subterranean well 10. Extinguishing assembly 16 can include a self-extinguishing room for extinguishing oil and gas wells. Extinguishing assembly 16 can be delivered to subterranean well 10 by crane 18. Crane 18 can lower extinguishing assembly 16 over wellhead member 14 for extinguishing the fire at the hydrocarbon well. In alternate embodiments, extinguishing assembly 16 can be moved by a helicopter (not shown), skidded along a bridge extending to the wellhead member (not shown), or moved by a remote controlled transportation tool (not shown).

Extinguishing assembly 16 includes a self-extinguishing room in the form of housing 20. Housing 20 can have a diameter in a range of one to ten meters, and in particular embodiments, can have a diameter in a range of three to four meters. Housing 20 can be formed of heat resistant material and can have layers of heat insulating material on an inside surface of housing 20. Base 22 of housing 20 can have a generally prism shape with a circular, triangular, square, or other polygonal cross sectional shape. Base 22 can have a height sufficient to contain fluid flowing out of a particular subterranean well 10.

Housing 20 includes roof 24 can have a generally frustro conical shape. The wider end of roof 24 is attached to base 22. Valve 26 is located at the narrower end of roof 24 of housing 20. Ram sealing system 28 is located at base 22 of housing 20. Hydraulic system 30 can be used to actuate ram sealing system 28 and to move valve 26 between a valve open position and a valve closed position.

Pressure balancing assemblies 32 can be located around a circumference of housing 20. Pressure balancing assemblies 32 can automatically balance the ejection pressure of burning materials and the ejection pressure of extinguishing materials.

Figure 2:
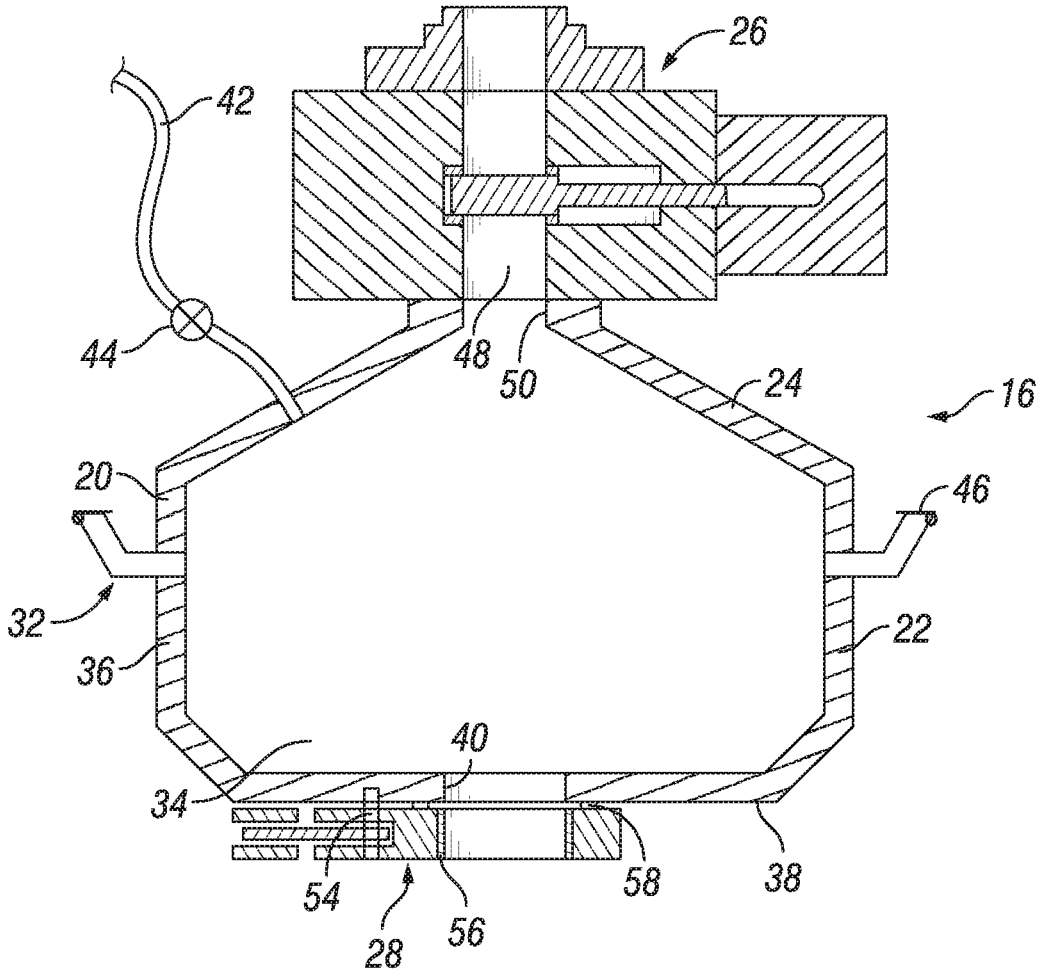
FIG. 2 is a section view of system for extinguishing a hydrocarbon well, in accordance with an embodiment of this disclosure.

Looking at FIG. 2, housing 20 has inner chamber 34 sized for placement over wellhead member 14 (FIG. 1). Inner chamber 34 is an open space within housing 20. Inner chamber 34 extends from base 22 of housing 20 to roof 24 of housing 20. Housing 20 further includes sidewall 36 that extends from base 22 of housing 20 to roof 24 of housing 20. Sidewall 36 defines both the shape of the outer surface of housing 20 and the limits of inner chamber 34. Housing 20 additionally includes base end surface 38. Base end surface 38 extends across a base end of housing 20 that is defined by sidewall 36. Base end surface 38 has base opening 40 that is sized to receive wellhead member 14 (FIG. 1).

Extinguishing assembly 16 includes an extinguishing materials injection system operable to deliver the extinguishing materials into inner chamber 34 of housing 20. Extinguishing materials injection system can include hose 42 that is attached to sidewall 36. Hose 42 can be used to inject large quantities of extinguishing materials into housing 20. Hose 42 can withstand the pressure required to inject the extinguishing materials into housing 20. Hose 42 can have a heat insulating material to protect hose 42 from the flames of the burning hydrocarbon. Hose 42 can have control valve 44 for controlling the injection of extinguishing materials into housing 20.

By mixing the extinguishing materials with the burning hydrocarbons, the concentration of burning hydrocarbons can be reduced. By mixing the extinguishing materials with the vapor of the burning hydrocarbons, it is possible to extinguish the burning hydrocarbons. The extinguishing materials are injected in the required amount to decrease the concentration of flowing materials to a concentration lower than the concentration that is necessary for burning these materials. The extinguishing materials can include known materials that are used in a fire disaster, such as dry powder carbon dioxide. While injecting the extinguishing materials into housing 20, housing 20 can suppress the flames and isolate the flames from oxygen in the surrounding air. The extinguishing materials can be ejected from a tank (not shown) that is placed on housing 20 or located proximate to housing 20.

During the injection of the extinguishing materials into housing 20, the balance between the production pressure of burning materials and the injection pressure of extinguishing materials is controlled by pressure balancing assemblies 32. Pressure balancing assemblies 32 can extend through sidewall 36 and provide a fluid flow path from inner chamber 34 to outside of housing 20. Pressure balancing assemblies 32 can have a spring loaded pressure balancing valve 46. When the pressure within inner chamber 34 exceeds the pressure required to overcome the spring force, pressure balancing valve 46 will open to relieve the pressure within inner chamber 34. When the pressure within inner chamber 34 is less than pressure required to overcome the spring force, pressure balancing valve 46 will move to, and remain in, a closed position and prevent fluids or pressure from exiting inner chamber 34 by way of pressure balancing valve 46.

Valve 26 is shown in the example of FIG. 2 as a gate valve. In alternate embodiments, valve 26 can be another type of valve known in the industry, such as for example, a ball valve, a butterfly valve, or a plug valve. Valve 26 can have inner bore 48 that aligns with a roof opening 50 of extinguishing assembly 16 and can further align with the bore of subterranean well 10. With valve 26 in the open position, access to inner chamber 34 is provided by way of inner bore 48 and roof opening 50. Valve 26 can provide access for well intervention operations. As an example, wireline, coiled tubing and snubbing units can be rigged up on valve 26 to workover the well and regain control of the well and restore well integrity.

In order to form a seal around wellhead member 14 to prevent extinguishing materials from escaping though the base end of housing 20, ram sealing system 28 can form a seal with base end surface 38 and form a seal around wellhead member 14 (FIG. 1). Ram sealing system 28 can also secure housing 20 to wellhead member 14 (FIG. 1). Ram sealing system 28 can provide a sufficient seal to seal against the pressure of the escaping hydrocarbons and the pressure of the injected extinguishing materials. As an example, ram sealing system 28 can seal against a pressure of three million to fifteen million pounds per square inch.

Ram sealing system 28 can therefore prevent escaping hydrocarbons and extinguishing materials from reaching the environment surrounding extinguishing assembly 16. Ram sealing system 28 can also provide a sufficient grip with wellhead member 14 (FIG. 1) to secure ram sealing system 28 to wellhead member against the pressure of the escaping hydrocarbons and the pressure of the injected extinguishing materials.

In order to form a seal around wellhead member 14 (FIG. 1), ram sealing system 28 has engaging surface 56 that is sized and positioned to seal around wellhead member 14 (FIG. 1). Ram sealing system 28 further includes base seal 58. Base seal 58 can form a dynamic seal between ram sealing system 28 and base end surface 38. In the example embodiment of FIG. 2, ram sealing system 28 can be secured to housing 20 by way of pivot point 54.

Figure 3:
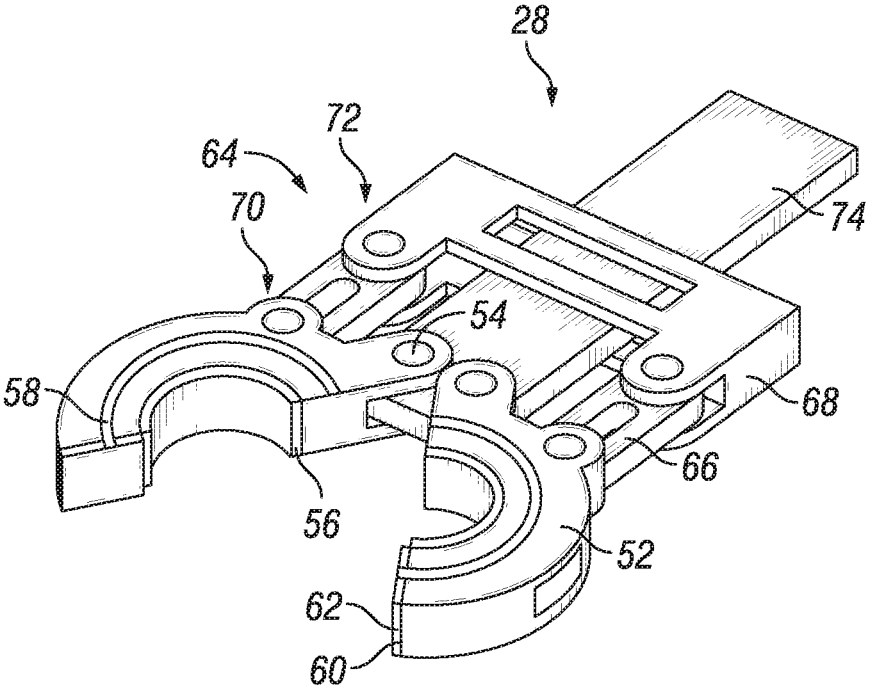
FIG. 3 is a perspective view of a ram assembly in accordance with an embodiment of this disclosure, shown with the rams in the open position.
Figure 4:
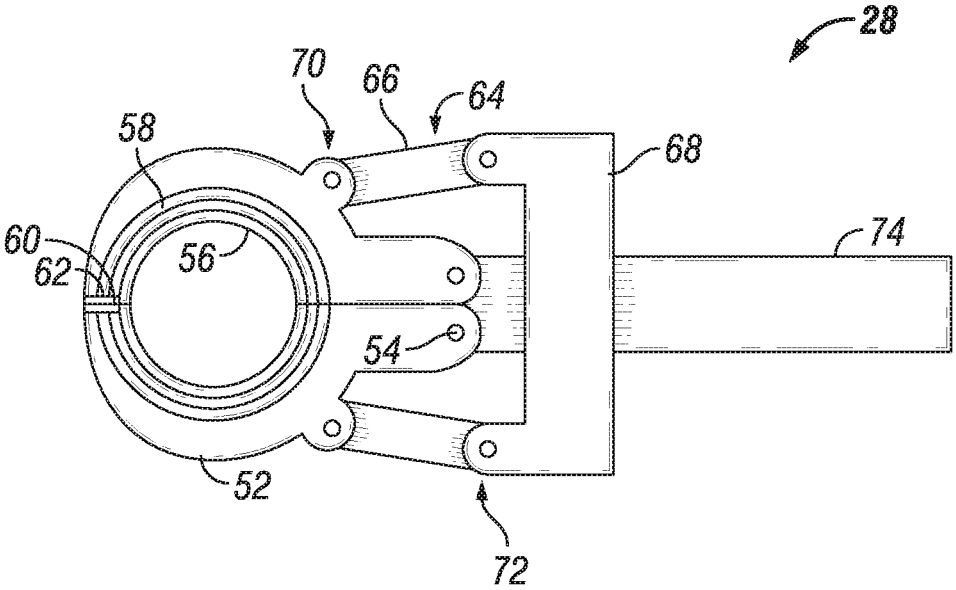
FIG. 4 is a schematic plan view of a ram assembly in accordance with an embodiment of this disclosure, shown with the rams in the closed position.

Ram sealing system 28 is shown in an open position in FIG. 3 and in a closed position in FIG. 4. Looking at FIGS. 3-4, ram sealing system 28 includes a pair of rams 52. When ram sealing system 28 is in the open position, rams 52 are rotated outward around pivot point 54 so that engaging surfaces 56 of rams 52 are spaced apart from each other. Engaging surfaces 56 are sized and shaped to seal around wellhead member 14 (FIG. 1) when ram sealing system 28 is in a closed position.

Engaging surface 56 is an arc shaped seal and when the ram sealing system 28 is in the closed position, engaging surface 56 seals around an outer circumference of wellhead member 14 (FIG. 1). Engaging surface 56 can include a gripping surface so that engaging surface 56 can also anchor ram sealing system 28 to wellhead member 14 (FIG. 1).

Each ram 52 further includes base seal 58. Base seal 58 forms a seal between ram 52 and base 22 of housing 20 (FIG. 2). Base seal 58 can be a generally arc shaped member located on a side surface of each ram 52 that is adjacent to housing 20 (FIG. 2).

Each ram 52 can have a general "C" shape with end surfaces 60 that meet when rams 52 are in a closed position. Surface seals 62 can be positioned on end surfaces 60. Surface seals 62 can seal between end surfaces 60 when end surfaces 60 meet. In alternate embodiments, engaging surface 56 can provide a sufficient seal around wellhead member 14 (FIG. 1) so that surface seals 62 are not included.

Ram sealing system 28 also includes actuating arm assembly 64. Actuating arm assembly 64 includes arm link 66 and ram body 68. Ram 52 is rotationally attached to ram body 68 by way of of arm link 66. Arm link 66 rotationally links ram 52 to ram body 68. Arm link 66 has a first end 70 rotationally attached to ram 52 and second end 72 rotationally attached to ram body 68. First end 70 can be rotationally attached to ram 52 with a pin that allows arm link 66 to rotate relative to ram 52. Second end 72 can be rotationally attached to ram body 68 with a pin that allows arm link 66 to rotate relative to ram body 68. Ram body 68 acts as a support structure for ram 52 and actuating arm assembly 64.

Pivot point 54 can be a pin that passes through ram 52 and actuator member 74. Relative movement between actuator member 74 and ram body 68 can move ram sealing system 28 between the open position and the closed position. In certain embodiments, as shown in FIG. 2, pivot point 54 is static relative to base 22 of housing 20 (FIG. 2). In such an embodiment, actuator member 74 is also static relative to base 22 of housing 20 (FIG. 2) and ram body 68 is moved relative to actuator member 74 to pivot rams 52 around pivot point 54 to move ram sealing system 28 between the open position and the closed position. Ram body 68 can be moved by hydraulic system 30 (FIG. 1) with a hydraulic pressure that is provided by crane 18.

In alternate embodiments, ram body 68 is secured to and static relative to base 22 of housing 20 (FIG. 2). In such embodiments, actuator member 74 is moved relative to ram body 68 to pivot rams 52 around pivot point 54 to move ram sealing system 28 between the open position and the closed position. Actuator member 74 can be moved by hydraulic system 30 (FIG. 1) with a hydraulic pressure that is provided by crane 18.

In an example of operation, there may be times when hydrocarbon development wells catch on fire, such as by way of human accident or natural event. In order to extinguish such a fire, extinguishing assembly 16 can be delivered to wellhead member 14, such as with crane 18. Housing 20 of extinguishing assembly 16 can be lowered over wellhead member 14 so that wellhead member 14 passes through base opening 40 of base 22 of housing 20 and into inner chamber 34 of housing 20.

Hydraulic system 30 can be used to move ram sealing system 28 to the closed position so that ram sealing system 28 seals around wellhead member 14 and secures extinguishing assembly 16 to wellhead member 14. Ram sealing system 28 is moved between the open position and the closed position from one side, making the operation of ram sealing system simpler than if ram sealing system 28 was operated from more than one side. Extinguishing material can then be injected into inner chamber 34 through hose 42. After the fire has been extinguished, valve 26 can be opened to perform operations on or through wellhead member 14. Valve 26 can be opened with hydraulic system 30. After the operation has been performed on or through wellhead member 14 and subterranean well 10 is under control ram sealing system 28 can be moved to the open position and extinguishing assembly 16 can be removed from wellhead member 14.

Systems and methods disclosed herein can be used to extinguish a hydrocarbon well with a self-extinguishing room that is sealed around, and secured to, the wellhead member. Embodiments of this disclosure can reduce the time required to extinguish the fire and reduce the release of hydrocarbons and extinguishing materials into the environment, compared to currently available systems.

Systems and methods of the present disclosure described herein, therefore, are well adapted to carry out the objects and attain the ends and advantages mentioned, as well as others inherent therein. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for extinguishing a hydrocarbon well, the system having:

a housing with an inner chamber sized for placement over a wellhead member, the inner chamber extending from a base of the housing to a roof of the housing;

an extinguishing materials injection system operable to deliver extinguishing materials to the inner chamber of the housing;

a valve located at the roof of the housing; and a ram sealing system located at the base of the housing, the ram sealing system having:

a pair of rams, each ram having an engaging surface, the engaging surface sized and shaped to seal around the wellhead member when the ram sealing system is in a closed position;

a ram body, the pair of rams being rotationally attached to the ram body, where the ram body is secured to and static relative to the base of the housing; and an arm link rotationally linking each ram to the ram body.

2. The system of claim 1, where each ram includes a base seal, the base seal forming a seal between such ram and the base of the housing.

3. The system of claim 1, where the engaging surface is operable to anchor the ram sealing system to the wellhead member.

4. The system of claim 1, where each ram rotates around a pivot point and the pivot point is static relative to the base of the housing.

5. The system of claim 1, where the housing includes a sidewall that extends from the base to the roof and the base includes a base end surface extending across a base end defined by the sidewall, where the base end surface has a base opening sized to receive the wellhead member.

6. The system of claim 1, where when the ram sealing system is in the closed position, the ram sealing system is operable to seal against a pressure of hydrocarbons and a pressure of injected extinguishing materials.

7. The system of claim 1, where the engaging surface is an arc shaped seal and when the ram sealing system is in the closed position, the engaging surface seals around an outer circumference of the wellhead member.

8. The system of claim 1, where the ram sealing system further includes an actuating member operable to move the ram sealing system between an open position and the closed position.

9. A method for extinguishing a hydrocarbon well includes:

placing a housing with an inner chamber over a wellhead member, the inner chamber extending from a base of the housing to a roof of the housing;

providing a valve at the roof of the housing;

sealing around the wellhead member with a ram sealing system located at the base of the housing, the ram sealing system having:

a pair of rams, each ram having an engaging surface, the engaging surface sized and shaped to seal around the wellhead member when the ram sealing system is in a closed position;

a ram body, the pair of rams being rotationally attached to the ram body, where the ram body is secured to and static relative to the base of the housing; and an arm link rotationally linking each ram to the ram body; and delivering extinguishing materials to the inner chamber with an extinguishing materials injection system.

10. The method of claim 9, where each ram includes a base seal, the base seal forming a seal between such ram and the base of the housing.

11. The method of claim 9, where the engaging surface anchors the ram sealing system to the wellhead member.

12. The method of claim 9, where each ram rotates around a pivot point and the pivot point is static relative to the base of the housing.

13. The method of claim 9, where the housing includes a sidewall that extends from the base to the roof and the base includes a base end surface extending across a base end defined by the sidewall, where the base end surface has a base opening sized to receive the wellhead member.

14. The method of claim 9, where when the ram sealing system is in the closed position, the ram sealing system seals against a pressure of hydrocarbons and a pressure of injected extinguishing materials.

15. The method of claim 9, where the engaging surface is an arc shaped seal and when the ram sealing system is in the closed position, the engaging surface seals around an outer circumference of the wellhead member.

16. The method of claim 9, further including moving the ram sealing system between an open position and the closed position with an actuating member.

* * * * *